US006729130B1

(12) United States Patent
Lilleland

(10) Patent No.: US 6,729,130 B1
(45) Date of Patent: May 4, 2004

(54) DEVICE IN A SUBSEA SYSTEM FOR CONTROLLING A HYDRAULIC ACTUATOR AND A SUBSEA SYSTEM WITH A HYDRAULIC ACTUATOR

(75) Inventor: Svein Lilleland, Tyristrand (NO)

(73) Assignee: FMC Kongsberg Subsea AS, Kongsberg (NO)

( * ) Notice: Subject to any disclaimer, the term of this patent is extended or adjusted under 35 U.S.C. 154(b) by 0 days.

(21) Appl. No.: 10/088,652

(22) PCT Filed: Sep. 18, 2000

(86) PCT No.: PCT/NO00/00306

§ 371 (c)(1),
(2), (4) Date: Mar. 20, 2002

(87) PCT Pub. No.: WO01/23702

PCT Pub. Date: Apr. 5, 2001

(30) Foreign Application Priority Data

Sep. 30, 1999 (NO) ..... 19994777

(51) Int. Cl.[7] ..... F15B 1/02
(52) U.S. Cl. ..... 60/413
(58) Field of Search ..... 60/419, 413, 329

(56) References Cited

U.S. PATENT DOCUMENTS 3,613,070 A * 10/1971 Jones et al. ..... 60/413
4,087,073 A 5/1978 Runberg et al.
4,240,463 A 12/1980 Moore
4,649,704 A 3/1987 Marsh
4,687,014 A 8/1987 Godal
6,332,315 B1 * 12/2001 Cappeller et al. ..... 60/413

FOREIGN PATENT DOCUMENTS

EP 0 038 034 10/1981

* cited by examiner

*Primary Examiner*—Edward K. Look
*Assistant Examiner*—Igor Kershteyn
(74) *Attorney, Agent, or Firm*—Young & Thompson

(57) ABSTRACT

A device in a subsea system for controlling a hydraulic actuator (1) which is connected to a supply line (2) for supply of a supply fluid to the actuator (1) and a return line (3) for removal of a return fluid from the actuator. The device (10) include: a housing (11) and a body (29) which is movable in the housing (11), which together define a high-pressure chamber (14), which communicates with the supply line (2), and a low-pressure chamber (15), which communicates with the return line (3), and whose volume is a function of the pressure of the return fluid and the supply fluid.

6 Claims, 3 Drawing Sheets

DEVICE IN A SUBSEA SYSTEM FOR CONTROLLING A HYDRAULIC ACTUATOR AND A SUBSEA SYSTEM WITH A HYDRAULIC ACTUATOR

CROSS REFERENCE TO RELATED APPLICATION

This is the 35 USC 371 national stage of international application PCT/NO00/00306 filed Sep. 18, 2000, which designated the United States of America.

FIELD OF THE INVENTION

The invention further relates to a system coprising a hydraulic actuator and a device for controlling the actuator.

BACKGROUND OF THE INVENTION

U.S. Pat. No. 4,649,704 relates to a subsea valve actuator device which is connected to a pressurized fluid accumulator. The pressurized fluid accumulator consists of two hydraulic cylinders with movable pistons which have the same diameter, and which are interconnected via a piston rod.

U.S. Pat. No. 4,240,463 relates to a hydraulic actuator with a fluid accumulator for opening or closing a safety valve, comprising a cylindrical chamber with a movable piston.

U.S. Pat. No. 4,087,073 relates to a safety valve which is combined with a hydraulic actuator. The actuator comprises a cylindrical chamber with a movable piston similar to that which is described in U.S. Pat. No. 4,240,463. The piston position and movement are dependent on a fluid pressure which is controlled by a pilot valve.

EP A2 38 034 relates to a safety valve-manifold system for opening or closing a subsea safety valve. This system comprises a hydraulic control line which is connected to a pressurized fluid accumulator.

Such known systems, therefore, may comprise hydraulic devices such as hydraulic actuators, which can be supplied with a pressurized fluid, and from which a return fluid may flow, these fluids flowing in separate lines. The device may be a hydraulic cylinder with a cylinder part, wherein a piston part can be moved. The piston part together with the cylinder part may define two chambers on the respective sides of the piston part, where the pressurized fluid can influence one chamber and the return fluid can influence the other chamber. An example of such a device is a balanced, hydraulic valve actuator, whereby the position for a valve, especially a process valve, can be set. A hydraulic actuator should be understood to also cover hydraulic motors.

A typical drawback of such hydraulic systems is that the fluid supply and return lines influence the dynamic characteristics of the system in such a manner that the system's time constants and thereby the response or operating time for the hydraulic actuator is increased when the lines for supply and return of fluid respectively are long, which is the case, for example, when controlling a hydraulic actuator for a subsea valve of an oil or gas well.

In order to control an oil or gas flow from a well, the well is provided with a wellhead Christmas tree comprising process control valves, where each process control valve is provided with an actuator for operation of the valve. The actuator may be operated electrically or hydraulically, but hydraulically operated actuators are normally employed for wellhead Christmas trees in oil and gas production.

In the case of so-called open systems, hydraulic actuators such as a hydraulic cylinder may be employed to which there extends only one single line, which is connected to one of the chambers. The second chamber communicates with the space surrounding the actuator, and in this chamber there may be mounted a return spring which attempts to move the piston part towards the first chamber. In order to move the actuator's movable part towards the second chamber, the line is supplied with a pressurized fluid whose pressure is so great that a force is generated which is greater than the force which is exerted by the spring. In order to move the movable part in the other direction, the pressure on the fluid in the line is reduced, whereby the return spring causes movement of the movable part in the other direction while at the same time the fluid is forced back in the line. In open systems, hydraulic fluid can easily leak into the surroundings, an occurrence which should be avoided both out of consideration for the environment and on account of the cost involved in the loss of fluid.

Closed hydraulic-valve actuator systems have therefore been developed for oil and gas production of a balanced type, where the actuator is equipped with a cylinder and a piston which define a first and a second cylinder chamber, where a supply line is connected to the first chamber and where a return line is connected to the second chamber. The cylinder may also be equipped with a return spring which moves the piston to a position, which usually corresponds to the process valve's closed position when the pressure is reduced in the supply line. When pressurized fluid is supplied to the actuator via the supply line, return fluid is simultaneously forced back in the return line. This eliminates the difficulties with regard to fluid discharge compared with the above-mentioned, open system.

The supply and return lines are normally installed in a so-called umbilical, usually together with other hydraulic, electrical and/or optical lines, and/or lines for the supply of other fluids. The umbilical extends from the subsea process control valve near the well to, e.g., a platform. The umbilical may be very long, in some cases up to 20 km or more. In the umbilical it is desirable to employ hydraulic lines with a limited cross section. For construction, installation and cost-related reasons, furthermore, it is an advantage to employ the same cross section for several hydraulic lines in the umbilical. A typical diameter for the umbilical may be approximately 5 cm, and the hydraulic lines which are installed in the umbilical may have a diameter of approximately 12 mm. The flow resistance in the hydraulic lines then becomes substantial, with the result that the response time for the valve actuator in the system may be unsatisfactorily long.

On the basis of the above, it is desirable to provide a device in a subsea system for controlling a hydraulic actuator, and a subsea system for controlling a hydraulic actuator, where the response time for the actuator is satisfactory.

Attempts have been made to achieve this by various means.

A first, known method is to employ hydraulic lines with a larger cross section. The umbilical's cross section thereby also becomes large, resulting in a substantial increase in costs.

A second method is to connect an accumulator to the supply line near the process control valve. When a valve actuator has to be activated, electrical energy is used to open a solenoid valve mounted between the accumulator and the valve actuator. The accumulator may be a replaceable, precharged tank. However, the actuator is more commonly refilled with fluid from the platform, preferably through a supply line in the umbilical.

By this means the actuator's response time is reduced, since the difficulties with regard to the supply of a fluid flow through the supply line are partially overcome. However, the return fluid still has to be caused to flow through the return line, with the result that a satisfactory result is not obtained if the supply and return lines have the same cross sectional dimensions. Moreover, the refilling of the accumulator presents difficulties, and when the pressure in the accumulator is too low, the actuator cannot be activated for opening the valve. Furthermore, the installation of high-pressure accumulators on the seabed can be associated with major constructional and installation-related difficulties.

A third, known method is to mount a return pressurized fluid accumulator near the actuator, in connection with the return line. As is known, pressurized fluid accumulators may comprise a housing, wherein there is mounted a movable body, such as a membrane or a piston, one side of which is influenced by a resilient or elastic device, such as a compression spring or a pressurized gas—usually nitrogen gas, and the other side of which in this case may be influenced by the fluid in the return line. Fluid can thereby flow rapidly from the actuator's return chamber to the return accumulator, with the result that the actuator's response time is satisfactory. The return fluid is then caused to flow on from the return accumulator up through the return line in the umbilical by an expansion of the compression spring or the pressurized gas.

If such an accumulator is to be employed at a location where the operating temperature differs from the temperature at the location where the accumulator is filled with gas, care must be taken to ensure that the gas pressure in the accumulator at the filling location is of such a value that the correct gas pressure is obtained when the accumulator is at the operational location and has attained the operating temperature.

If the actuator's and the accumulator's operational location is a long way below the supply location where fluid is delivered to the actuator and return fluid received from the actuator, which, for example, is the case if the operational location is at a great depth in the ocean and the supply location is on a platform at the surface, and the actuator is not operated, the pressure in the return and supply lines at the operational location corresponds to the static pressure for a hydraulic fluid column with a height corresponding to the water depth. If the pressure of the fluid which is delivered to the accumulator is increased for operation of the actuator, and the actuator's movable part, such as a piston, is moved, the pressure in the return line also rises as a function of the piston's movement parameters and the fluid resistance in the return line.

The accumulator must therefore be adapted to both the relevant ocean depth and the actuator's operating pressure as well as the temperature at this depth, and this represents a disadvantage.

OBJECT AND SUMMARY OF THE INVENTION

An object of the invention is to provide a device in a subsea system for controlling a hydraulic actuator, and a subsea system with such a device, where the response time for the actuator is satisfactorily short, where the cross sectional dimensions for the return lines can be made acceptably small, and where the above-mentioned disadvantages when using a return accumulator are eliminated.

BRIEF DESCRIPTION OF THE DRAWINGS

The invention will now be described in more detail with reference to the drawing which schematically illustrates a preferred embodiment of the invention.

DETAILED DESCRIPTION OF THE INVENTION

Figure 1:
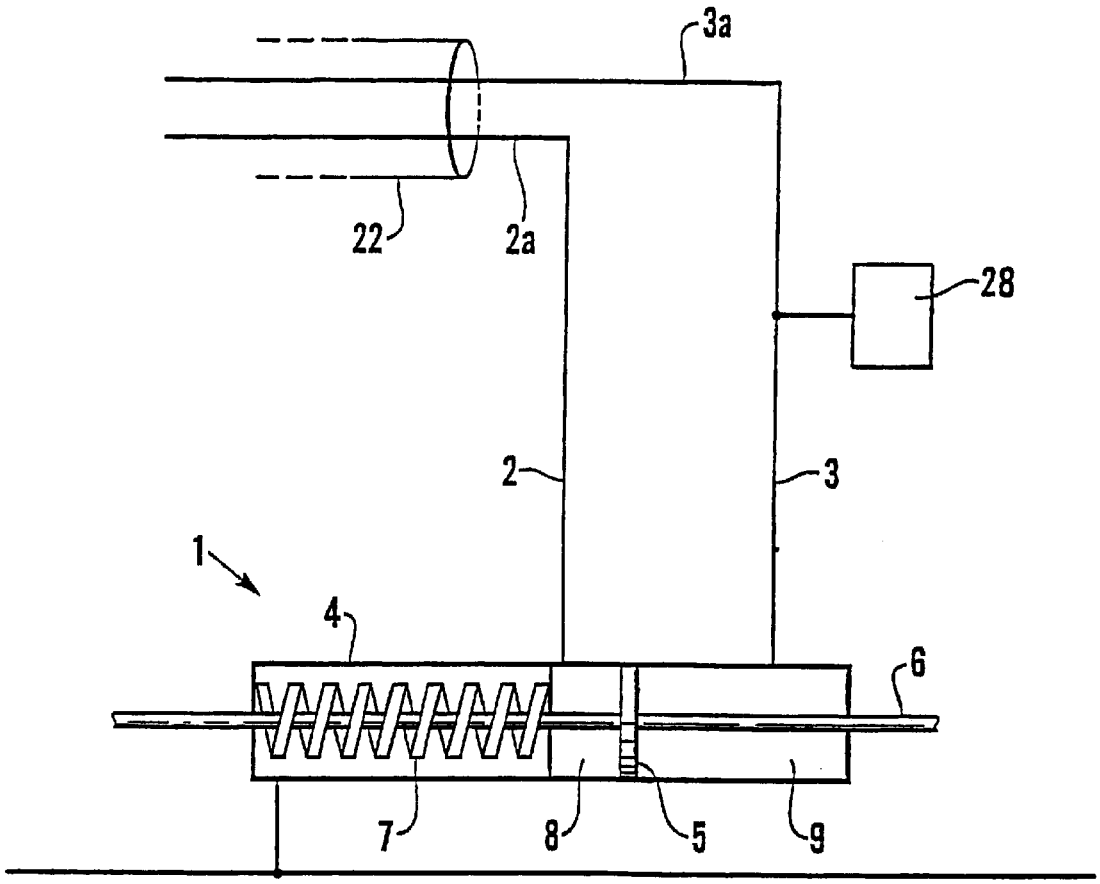
Fig. 1 Prior Art
FIG. 1 is a view of a hydraulic actuator for operation of a process valve, together with supply and return lines and a return accumulator, according to the prior art.

FIG. 1 illustrates a hydraulic actuator 1 which is arranged to influence a process control valve (not illustrated) which is preferably mounted on the seabed, for controlling a flow of oil or gas from a production well. An umbilical 22 comprising a bundle of cables and lines for control and energy supply extends to the seabed from a central location which is preferably on board a platform at the surface. The umbilical 22 comprises amongst other things a main supply line 2*a* and a main return line 3*a* for hydraulic fluid. These lines are connected to a supply line 2 and a return line 3 respectively for the actuator 1. In practice the lines may be connected to additional components such as valves and regulators (not illustrated).

The actuator 1 is a hydraulic cylinder with a cylinder part or cylinder 4 wherein there is movably mounted a piston part or piston 5 with a piston rod 6 which is arranged to operate the valve. A return spring 7 is mounted between an end wall of the cylinder 4 and the piston 5 on the other side thereof relative to the piston rod 6 and is arranged to move the piston 5 towards the right of the figure when there is only a small differential pressure over the piston 5. Together with the cylinder 4 the piston 5 defines two chambers of variable size, depending on the piston's position: a supply chamber 8 and a return chamber 9. The main supply line 2*a* and the main return line 3*b* may be very long, for example up to 20 km or more, and have a diameter of, e.g., approximately 12 mm. The return line 3 communicates with a return accumulator 28. This is arranged to receive return fluid flowing from the return chamber 9, and subsequently to deliver the return fluid to the main return line 3*a,* where the accumulator 28 may comprise in the known manner a chamber which is bounded by a movable piston or a membrane, and which contains a pressurized gas, e.g. nitrogen.

Figure 2:
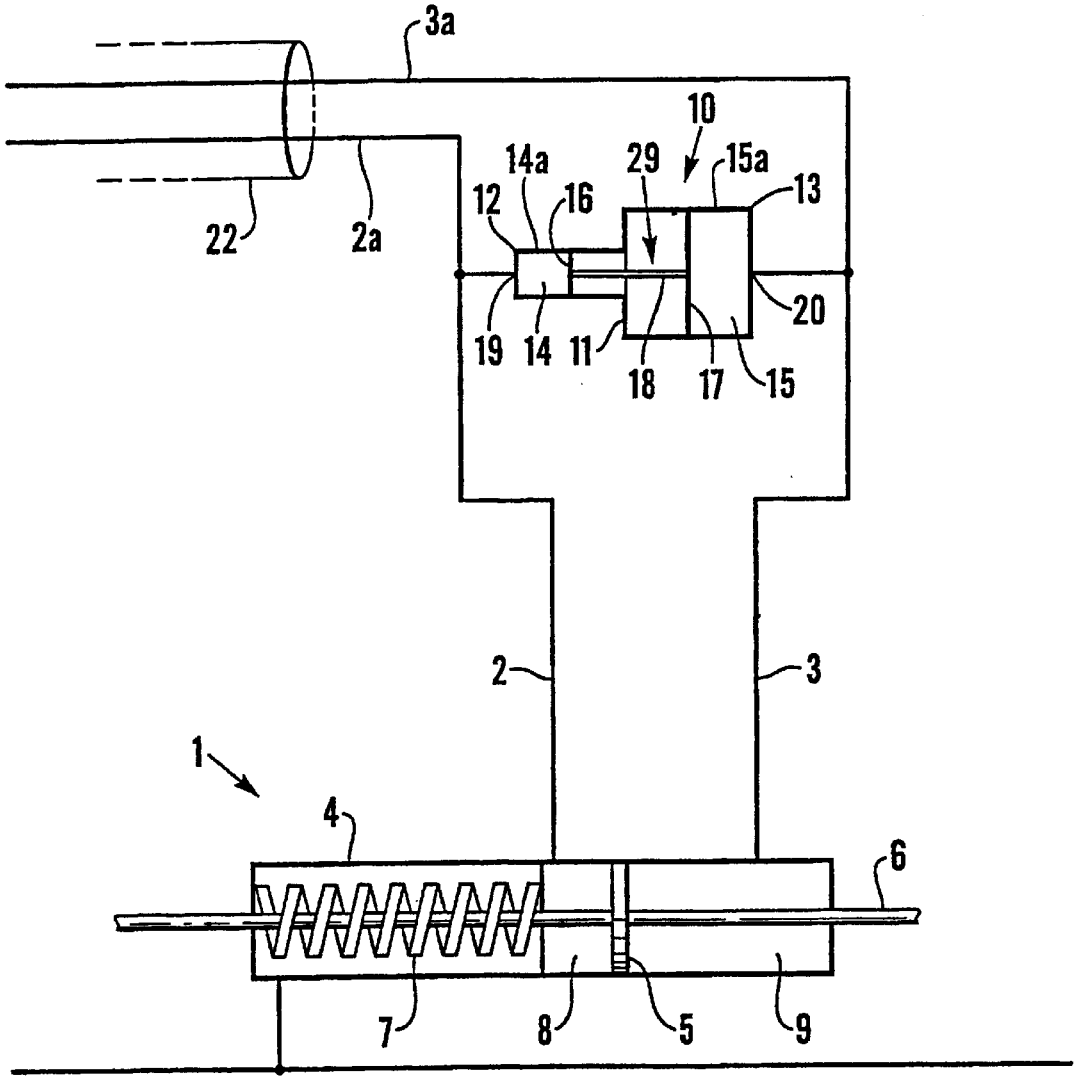
FIG. 2 is a view of a hydraulic actuator which is provided with a fluid pressure device according to the invention.

FIG. 2 illustrates a device according to the invention comprising a hydraulic actuator 1 which is identical to that illustrated in FIG. 1. Instead of a return accumulator, however, this device comprises a fluid pressure device 10 which is connected in parallel with the actuator 1.

In its simplest form the fluid pressure device 10 is designed as a tandem-type pressure converter. The fluid pressure device 10 comprises a housing 11 which may be made in one piece or be composed of several individual parts. The fluid pressure device 10 has a high-pressure side 12 and a low-pressure side 13. The housing is in the form of a tandem hydraulic cylinder with a first cylinder portion 14*a* and a second cylinder portion 15*a,* which has a larger diameter than the first cylinder portion 14*a*.

In the first cylinder portion 14*a* there is mounted a first piston portion 16 and in the second cylinder portion 15*a* there is mounted a second piston portion 17. The piston portions 16, 17 are rigidly interconnected by a piston rod 18 and can slide sealingly in their respective cylinder portions 14*a,* 15*a*. The piston portions 16, 17 and the piston rod 18 form a tandem piston 29.

The first cylinder portion 14*a* and the first piston portion 16 define a first cylinder chamber or high-pressure cylinder chamber 14 which has a cross sectional area A1, and which is connected to the supply line 2 at a location 19.

The second cylinder portion 15*a* and the second piston portion 17 define a second cylinder chamber or low-pressure cylinder chamber 15 which has a cross sectional area A2, and which is connected to the return line 3 at a location 20.

The fluid pressure device 10 can be described as a pressure converter, since the tandem piston 29 can be kept in balance by a fluid with a first pressure on the high-pressure side 12 and a fluid with a second pressure on the low-pressure side 13. If the friction between the cylinder and the tandem piston 29 is disregarded, and if this piston is not accelerated and is not located in an extreme position at one end of the housing 11, the pressure on the high-pressure side 12 is therefore equal to the pressure on the low-pressure side 13 multiplied by the ratio between the second A2 and the first cross sectional area A1.

Fluid pressure devices of a similar principle construction are well-known per se from other areas of application and contexts, e.g. as pressure boosters.

Figure 3:
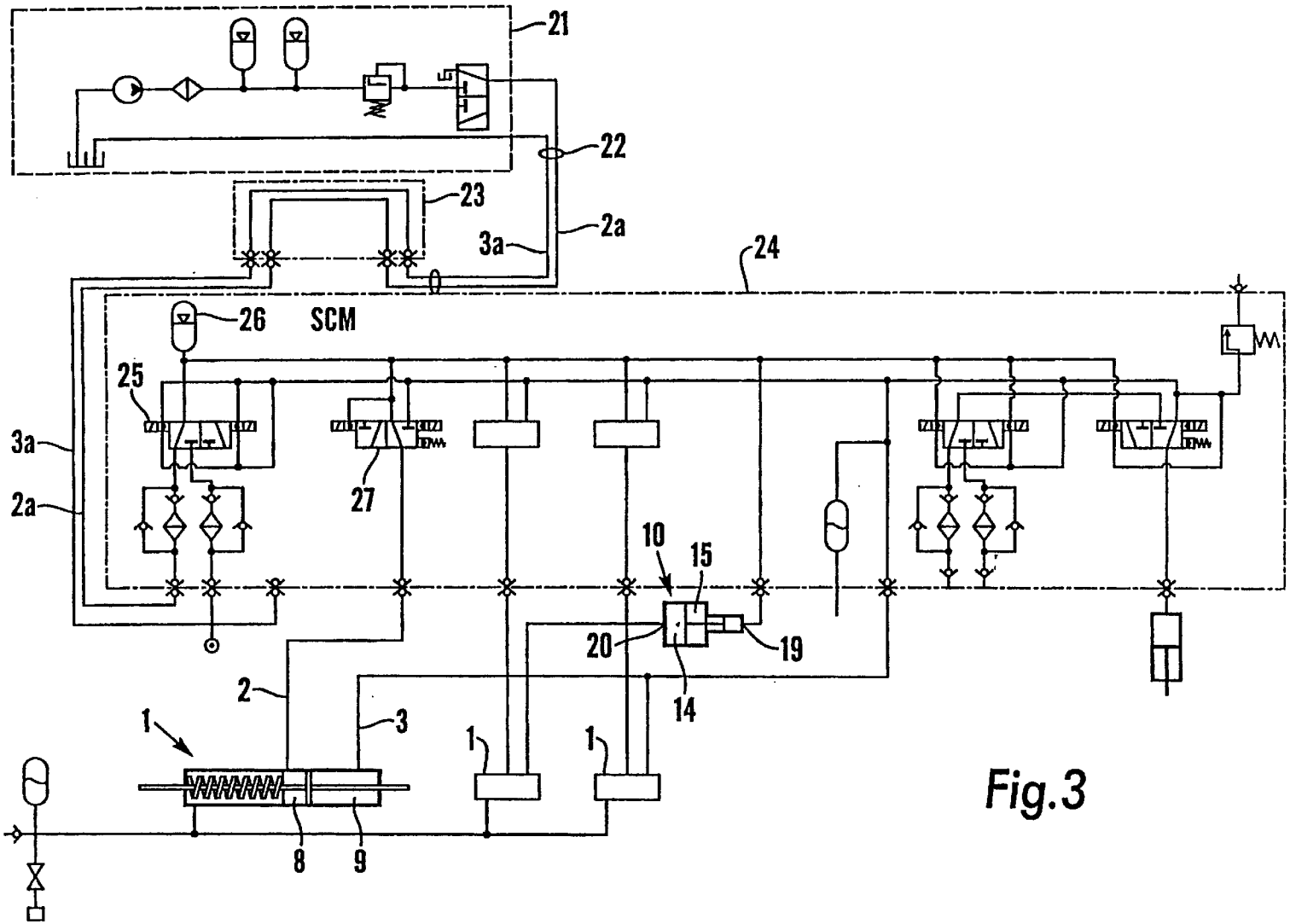
FIG. 3 is a schematic diagram for a hydraulic system according to the invention.

The connections between the actuator 1 and the fluid pressure device 10 are illustrated in principle in FIG. 2. In practice additional components, such as valves and regulators, may be mounted in lines between these components. In addition, other components may be included, e.g. as illustrated in FIG. 3.

As illustrated in FIG. 2, the hydraulic actuator 1 is connected in parallel with the fluid pressure device 10, the supply line 2 to the actuator being connected thereto at the connection location 19, and the return line 3 from the actuator connected thereto at the connection location 20. The pressure of the fluid which is supplied to the actuator will thereby correspond to the pressure of the fluid in the high-pressure cylinder chamber 14, and the pressure of the return fluid flowing from the actuator will correspond to the pressure of the fluid in the low-pressure cylinder chamber 15. The tandem piston 29 will constantly seek a position wherein it is balanced with regard to pressure, i.e. a position wherein the pressure of the supply fluid is equal to the pressure of the return fluid multiplied by the ratio between the second A2 and the first cross sectional area A1 of the cylinder chambers 14, 15.

When the actuator is activated by an increase in the pressure of the fluid in the supply line 2 and fluid is supplied to the actuator's supply chamber 8, the actuator piston 5 is moved, causing the process control valve's position to be altered. Return fluid is then forced out of the return chamber 9, partly into the fluid pressure device's low-pressure chamber 15 and partly back into the main return line 3*a*. The flow of return fluid into the low-pressure chamber 15 continues until the tandem piston 29 is in balance with regard to pressure. In this fashion the return chamber 9 will quickly be emptied, and the valve equally quickly moved to the desired position, despite the limitation of the main return line's 3*a* restricted capacity.

After the actuator 1 and thereby the process control valve have been brought into the desired position, return fluid flows relatively slowly out of the low-pressure chamber 15 back to the return line 3 through the main return line 3*a* in the umbilical and up to the platform at the surface. The pressure of the return fluid is hereby gradually reduced. The tandem piston 29 is thereby moved towards the right in FIG. 2 until it finally comes into abutment against an end surface of the housing 11.

FIG. 3 is a schematic diagram illustrating an application of the device according to the invention in a subsea system for controlling a process control valve (not illustrated) for oil and/or gas production. The system comprises a high-pressure unit 21, which may comprise pumps, tanks for fluid and pressure regulators etc., these preferably being installed on a platform at the surface. Hydraulic, and possibly also electrical and/or optical cables and connection lines extend through an umbilical 22, possibly via a flow control module 23, down to a subsea module 24. Fluid from the surface may be caused to flow through the main supply line 2*a* and a control valve 25 to a supply accumnulator 26, and on through a control valve 27, partly to the high-pressure chamber 14 of the fluid pressure device 10, and partly to the supply chamber 8 by a number of actuators 1. When the actuator pistons are moved towards the right in FIG. 3, fluid can flow from the return chamber 9 of each actuator 1, partly to the low-pressure chamber 15 in the fluid pressure device 10 and partly to the main return line 3*a,* which extends through the umbilical 22, to the high-pressure unit 21 on the platform.

During operation the fluid pressure device 10 acts together with a process valve actuator 1 in a manner corresponding to that illustrated in FIG. 2.

As illustrated in FIG. 3 a fluid pressure device is employed together with several parallel-connected actuators 1. According to the invention, however, one or more fluid pressure devices may be employed in combination with each actuator, or several fluid pressure devices in combination with a group of several actuators.

A fluid pressure device 10 may be designed as a separate component or be incorporated in an actuator 1.

When using the fluid pressure device 10 according to the invention, a sufficiently rapid response is achieved for the actuator 1 even though the main return line 3*a* advantageously has a small cross section. This results in a reduction in material consumption and in construction and installation costs. If in addition a known per se supply accumulator 26 is employed in connection with the supply line, the dimensions of the supply line may also be reduced, thus providing further savings.

The absolute pressure of the water surrounding the subsea system has no influence on the function of the fluid pressure device 10. In contrast to the previously known accumulator 28, the fluid pressure device 10 will therefore be able to be used without any modification, independently of this absolute pressure.

Even though it is stated in the above that the actuator 1 is a hydraulic cylinder, it will be understood that any type whatever of hydraulic actuator or motor may be employed.

Furthermore, it will be understood that the device 10 may be designed differently, the essential factor being that it has a housing with a movable body, which together with the housing defines a first chamber 14, which is arranged to receive a high-pressure fluid, and a second chamber 15, which is arranged to receive a low-pressure fluid, the function of the device being as stated above. For example, the housing may be circular and the movable body may be in the form of a rotor which, for example, comprises radial wings.

It is stated above that the actuator is arranged for operation of a process control valve, but it will be appreciated that other devices may also be operated by the actuator.

Moreover, it is stated that the device is arranged for use in a subsea system for controlling a hydraulic actuator for a process control device. It will be understood, however, that the device may be employed with other systems, e.g. systems which are not located in water, and in systems for any other kind of use, where drawbacks exist similar to those mentioned above.

What is claimed is:

1. A subsea system with a hydraulic actuator for operation of a process control device, in connection with recovery of hydrocarbons from a well, wherein the system comprises a supply line for supply of a supply fluid to the hydraulic actuator and a return line for removal of a return fluid from the hydraulic actuator; the subsea system comprising a device for controlling the hydraulic actuator, the device comprising a housing and a body which is movable in the housing, and which together with the housing defines a low-pressure chamber, which communicates with the return line; the housing and the body also defining a high-pressure chamber, which communicates with the supply line, whereby the body's position and thereby the volume of the low-pressure chamber are a function of the pressure of the return fluid and the supply fluid.

2. The subsea system according to claim 1, wherein the housing and the body are components of a pressure converter.

3. The subsea system according to claim 1, wherein the high-pressure chamber has a first internal cross section, the low-pressure chamber has a second internal cross section, and the body comprises a piston, which is movable in the housing's longitudinal direction, and which comprises a first piston portion with a cross section, which is adapted to the first internal cross section, the first piston portion being securely connected to a second piston portion, which has a cross section, which is adapted to the second internal cross section.

4. The subsea system according to claim 3, wherein the area of the second cross section is between 5 and 100 times larger than the area of the first cross section.

5. The subsea system according to claim 4, wherein the area of the second cross section is between 20 and 60 times larger than the area of the first cross section.

6. The subsea system according to claim 4, further comprising a main supply line which is directly or indirectly connected to the supply line, a main return line which is directly or indirectly connected to the return line, and wherein the main supply and main return lines are enveloped by an umbilical which connects a subsea production valve with a central unit.

* * * * *